US011511319B2

(12) United States Patent
Mcdevitt et al.

(10) Patent No.: US 11,511,319 B2
(45) Date of Patent: Nov. 29, 2022

(54) SCREENING ASSEMBLY AND MOBILE MATERIAL PROCESSING MACHINE

(71) Applicant: SANDVIK INTELLECTUAL PROPERTY AB, Sandviken (SE)

(72) Inventors: Terry Mcdevitt, Donegal (IE); Stuart Graydon, Fermanagh (IE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 263 days.

(21) Appl. No.: 16/763,397

(22) PCT Filed: Nov. 12, 2018

(86) PCT No.: PCT/EP2018/080937
§ 371 (c)(1),
(2) Date: May 12, 2020

(87) PCT Pub. No.: WO2019/092243
PCT Pub. Date: May 16, 2019

(65) Prior Publication Data

US 2021/0069750 A1 Mar. 11, 2021

(30) Foreign Application Priority Data

Nov. 13, 2017 (EP) ..... 17201324

(51) Int. Cl.
*B07B 1/00* (2006.01)
*B07B 13/16* (2006.01)
*B02C 21/02* (2006.01)

(52) U.S. Cl.
CPC ..... *B07B 1/005* (2013.01); *B07B 13/16* (2013.01); *B02C 21/02* (2013.01); *B07B 2201/04* (2013.01)

(58) Field of Classification Search
CPC ..... B07B 1/005; B07B 1/28; B07B 13/16; B07B 2201/04; B02C 21/02
See application file for complete search history.

(56) References Cited

U.S. PATENT DOCUMENTS 4,383,651 A * 5/1983 Couperus ..... B07B 1/005 241/101.76
6,186,338 B1 * 2/2001 Douglas ..... B02C 21/02 209/244
6,877,610 B2 * 4/2005 Boast ..... B07B 1/46 209/412

(Continued)

FOREIGN PATENT DOCUMENTS

BE 1010451 A6 8/1998
CA 2960739 A1 4/2016

(Continued)

*Primary Examiner* — Joseph C Rodriguez
(74) *Attorney, Agent, or Firm* — Corinne R. Gorski

(57) ABSTRACT

A screening assembly for screening material includes an assembly frame, a multi-deck screening device, a transfer conveyor and a drive means. The drive means is operable to shift at least one of the discharge ends of the screening device and the receiving end of the conveyor relative to the assembly frame to allow the transfer conveyor to selectively receive material from an upper screen and from both screens of the screening device at their respective discharge ends. A mobile material processing plant incorporating the screening assembly is included.

19 Claims, 12 Drawing Sheets

(56) References Cited

U.S. PATENT DOCUMENTS

| | | | | |
|---|---|---|---|---|
| 8,967,387 | B2 * | 3/2015 | Carter | B07B 1/286 209/241 |
| 9,636,686 | B2 * | 5/2017 | Salminen | B65G 21/10 |
| 2003/0173265 | A1 | 9/2003 | Cohen et al. | |
| 2005/0263626 | A1 * | 12/2005 | Brock | B65G 41/008 241/30 |
| 2008/0041984 | A1 * | 2/2008 | Sauser | B02C 23/14 241/101.76 |
| 2021/0101181 | A1 * | 4/2021 | Belosevic | B07B 1/005 |

FOREIGN PATENT DOCUMENTS

| | | | |
|---|---|---|---|
| EA | 14343 | B1 | 10/2010 |
| EP | 1364714 | A1 | 11/2003 |
| EP | 3061533 | A2 | 8/2016 |
| GB | 2309923 | A | 8/1979 |
| RU | 2333805 | C2 | 9/2008 |
| RU | 2636063 | C2 | 11/2017 |
| WO | 2016050326 | A1 | 4/2016 |

* cited by examiner

SCREENING ASSEMBLY AND MOBILE MATERIAL PROCESSING MACHINE

FIELD OF INVENTION

The present invention relates to a screening assembly for screening bulk material and in particular, although not exclusively, to a screening assembly with at least two vibratory screens, and a mobile material processing machine including said screening assembly.

BACKGROUND ART

A variety of different types of screening units have been developed for sizing or sorting bulk material, such units are usually equipped with vibration generating means for imparting circular or reciprocating vibratory motion on screen decks. Screening units are commonly combined with a crushing device to build an integral material processing machine, optionally it may be demountably set up on a mobile crusher.

FIG. 1 shows an existing screening assembly, which has a screen box 16 containing two vertically-stacked screen decks. The assembly mounts a first transfer conveyor 13 located at the discharge end of screen box 16 which is used for diverting material flow sidewards and subsequently onto laterally arranged recirculation conveyor 11. A second transfer conveyor 14 is placed beneath the first transfer conveyor 13 for transferring material from a lower screen deck. As the belt of the second transfer conveyor 14 may run in two optional directions, depending on its belt running direction, the second transfer conveyor may serve either the recirculation conveyor 11 or a stockpile conveyor 15 when in operation.

EP3061533 describes multi-deck screening assembly comprising a plurality of vertically-stacked downwardly inclined screen decks (6, 8, 10), the lower screen decks (8, 10) deliver from their discharge ends over-sized material onto a respective stockpile conveyor (18, 20), a transfer conveyor 28 is provided to deliver material from the discharge end of the upper deck 6 onto a loading end of the third stockpile conveyor 22 located laterally on one side of the chassis but opposite to stockpile conveyor 20, as shown in its FIG. 4/5.

CA2960739 describes a mobile bulk material processing apparatus in which a transfer conveyor 134 configured to transfer oversized material from the screen 112 to the recirculation conveyor 114. The transfer conveyor is adjustably mounted at carrier frame 110 and configured to pivot about a transverse horizontal axis (FIG. 8*b*/8*c*) or be moveable between a widthwise inclined working position and a substantially horizontal position to allow maintenance access.

However, in conventional screening assembly, a transfer conveyor is always dedicated to transport material discharged from a corresponding screen, this structure is not flexible, cost-saving or energy-efficient. Accordingly, what is required is a screening assembly that addresses these problems.

SUMMARY OF THE INVENTION

It is an objective of the present invention to provide a compact multi-deck screening assembly that is cost-saving and energy-efficient. It is a further objective to provide a screen assembly that is easy to maintain.

The objectives are achieved by providing a screening assembly which meets the multiple requirements of exporting bulk material. In one application scenario, the screening assembly shall output only fines material as final products i.e. mid-sized material discharged from lower deck(s) must be recycled. In another application scenario, the screening assembly shall deliver fines material as final products, and additionally mid-sized material as intermediate products. The existing solution uses two separate transfer conveyors for transporting material of different sizes sidewards to a recirculation conveyor and a stockpile conveyor respectively. This can be improved by the present invention wherein a single movable transfer conveyor is implemented. The transfer conveyor is set up as being movable between multiple working positions, whereas a stockpile conveyor is simply an optional configuration. The present solution allows for the removal of a second transfer conveyor which would be normally used for establishing the same purpose.

The objective is achieved in terms of a single transfer conveyor in combination with a drive means. The drive means may act on the screening assembly or the transfer conveyor such that a relative vertical displacement is introduced between the discharge end of the screening device and the transfer conveyor. In the solution, the transfer conveyor is not dedicated to serve a specific screen due to its position being changeable relative to the screen device. This makes the screening assembly compact and versatile, and it enables the mix of the material passing over multiple decks to be recirculated back to the crusher Optionally, it allows for distribution of intermediate products, i.e. mid-sized material passing over the lower deck(s) may be stockpiled.

According to a first aspect of the present invention there is provided a screening assembly for screening material and comprising: an assembly frame; a screening device coupled to the assembly frame, including a first screen and a second screen, the second screen being substantially vertically-stacked below the first screen; a first conveyor coupled to the assembly frame and configured to receive at a receiving end material from at least one of the screens at their respective discharge ends; and a drive means mounted at the assembly frame; wherein the drive means is operable to shift at least one of the discharge ends of the screening device and the receiving end of the first conveyor relative to the assembly frame, to allow the first conveyor to selectively receive material from the first screen at its discharge end or from the first and the second screens at their respective discharge ends.

Preferably, the drive means is configured to act on or communicate with at least one of the screening device or the first conveyor. The drive means may directly act on and bring the screening device or the first conveyor to be displaced. However, it is preferred that the drive means indirectly acts on the screening device and/or the first conveyor, for example the drive means may couple to the screening device and/or the first conveyor via a vibration reduction unit such as springs or equivalent; the drive means may act on a screen support frame wherein the screen support frame carries the screening device, preferably via a vibration reduction unit.

In the subject invention, the configuration of using a single transfer conveyor to substitute two or more transfer conveyors, where excess endless belt is dispensed with, makes the assembly structure simpler and reduces the overall weight. It also leaves more clearance space within the assembly which is favorable for device maintenance, for example it is more convenient for machine inspection tasks, and for the exchange or repair of parts. It is also advantageous to remove an otherwise required additional motor for actuating a second transfer conveyor, this would reduce structure manufacturing costs and decrease the motor energy consumption.

Preferably, the objective may be achieved by shifting the screening device at the discharge end, this may require that the screening device is pivotably supported on the assembly frame at a position substantially away from the discharge end.

Preferably, the first conveyor is arranged transversely relative to the longitudinal direction of the screening device, in particular the first conveyor is a transfer conveyor.

Preferably, the assembly frame includes a carrier frame and a screen support frame movably coupled to the carrier frame, wherein the carrier frame is configured to support the first conveyor, the screen support frame is configured to support the screening device. The drive means is coupled to the carrier frame and communicates with the screen support frame and operable to shift the discharge end of the screening device relative to the carrier frame. Preferably the screening assembly includes a further connecting means that is coupled to the carrier frame and communicates with the screen support frame at a position substantially away from the discharge end of the screening device, for supporting the screen support frame. Preferably, the drive means at its one end is directly or indirectly pivotably coupled to the carrier frame, the other end of the drive means is directly or indirectly pivotably attached to the screen support frame at a position adjacent to the discharge end of the screens.

Preferably, the screening assembly further includes a second conveyor coupled to the assembly frame and arranged below the screening device for receiving under-sized material from the screening device.

In one embodiment, the screening assembly further includes a third conveyor coupled to the assembly frame, arranged transversely relative to the longitudinal direction of the screening device, operable to receive over-sized material from the discharge end of the second screen, in particular the third conveyor is a stockpile conveyor. The stockpile conveyor is an optional component to the screening assembly, that is, the screening assembly may be built up and delivered to a buyer without a stockpile conveyor, however the screening assembly is so designed as to enable adding a stockpile conveyor at a later phase.

Preferably, the shifting operation includes lifting or lowering the discharge end of the screening device relative to the assembly frame. At the loading end of the screening device, it is also allowable to apply a raising or lowering operation with less amplitude than the shifting operation at the discharge end of the screening device, so long as the inclined position of the screening device is maintained to allow material to fall under the influence of gravity to the discharge end.

Preferably, the shifting operation includes lifting or lowering the receiving end of the first conveyor relative to the assembly frame. In such an implementation, the screening device may be set in fixed position and not movable relative to the assembly frame, only the receiving end of the transfer conveyor is lifted upwards or dropped downwards relative to the assembly frame. However, as an alternative, the screening device may be configured to be vertically movable relative to the assembly frame as well.

In one embodiment, the drive means is a piston/cylinder device, preferably hydraulically actuated, whose first end is pivotably attached to one of the screen support frames and the first conveyor, the second end of the piston/cylinder device is pivotably connected to the carrier frame Optionally, the drive means acts on the screening device and/or the first conveyor via a telescopic arm. The drive means is not limited to piston/cylinder device, any actuation means such as gear, chain, wire, winch and the like that are powered by mechanical, pneumatic, hydraulic or electrical source or even manually-operated means may be possible.

In one embodiment, the carrier frame includes a slot and a latching bracket, one of the screen support frame and the first conveyor includes a coupling that is configured to engage the first end of the drive means or the telescopic arm, wherein the latching bracket is able to operably latch the coupling within the slot. Preferably, the coupling is a pin support. Preferably, the slot is inclined substantially upwardly, when the screen support frame or the first conveyor is raised to a higher slot position, larger clearance/space is left beneath the assembly frame. Such a configuration is advantageous to provide more space for maintenance purpose, also when the screening assembly is attached to a mobile machine, the larger clearance/space is beneficial for the machine relocation.

Preferably, the screening assembly includes a second drive means, preferably a piston/cylinder device or a telescopic arm driven by a piston/cylinder device, communicating with the carrier frame and the screen support frame, operable to change the tilting angle of the screening device. In this case, the lower end of the second drive means is directly or indirectly pivotably attached to the screen support frame at a position departing from the discharge end of the screens.

Optionally, the assembly further includes a recirculation conveyor mounted at the assembly frame, in particular mounted at the carrier frame, for receiving material delivered from the first conveyor. Optionally, the recirculation conveyor is horizontally rotatable and supported by an attachment bracket that is mounted on the carrier frame. Alternatively the recirculation conveyor may be positioned substantially transverse to the longitudinal direction of the screening assembly for stockpiling for onward processing. Alternatively, the recirculation conveyor may be secured to a base machine in particular a mobile crusher, rather than secured on the screening assembly.

Optionally, the third conveyor is rotatable in horizontal plane about a pivot mechanism of the assembly frame, in particular the pivot mechanism is mounted at the carrier frame.

According to a further aspect of the present invention, the first conveyor and/or the drive means and/or the recirculation conveyor are mounted separately from the assembly frame, in particular, the first conveyor and/or the drive means and/or the recirculation conveyor are mounted on a base machine, preferably the base machine is a mobile crusher. As can be appreciated, the transfer conveyor is not necessarily mounted on the screen assembly frame, rather it may be mounted on a frame of the base machine, the base machine is for example a mobile crusher machine. In this case, the drive means may also optionally be coupled to a frame of the base machine rather than coupled to the assembly frame.

Optionally, the assembly frame is configured to detachably couple to the base machine, in such a way that upon coupling, a supply conveyor of the base machine is configured to be located above the first screen and to feed material onto the first screen.

Optionally, the assembly frame includes support arms configured to be couplable with the base machine, wherein the arms having angled telescopic portion. In particular, support arms spaced apart in a widthwise direction of the machine may easily correspond to the spacing and alignment of the couplings on the base machine, depending on whether it is extended/retracted such a configuration allows for wider/narrower mounting positions on multiple base units. Such a configuration is advantageous to provide a flexible screening assembly having an adjustable width between its connection couplings, so as to permit the assembly to be releasably secured on various crusher machines.

Preferably, the screening device, and/or the conveyors, and/or the assembly frame, and/or the attachment bracket are of modular structure respectively, preferably each is constructed with various modules that are bolted together. The screening assembly incorporates modular elements thus allowing it to be mounted/paired with multiple base units, in particular with mobile crushers. The design of the modular frame is so that it can be bolted in various configurations for different machine types/applications. The bolted configuration is beneficial when considering containerized transportation.

According to a further aspect of the present invention there is provided a method for processing material in a screening assembly as illustrated above, the method comprising: adjusting the screening assembly by the aid of the drive means to set the assembly in an intended work position, wherein at least one of the discharge end of the screening device and the receiving end of the first conveyor is displaceable relative to the assembly frame by the drive means, to allow the first conveyor to selectively receive material from the first screen at its discharge end and from the first and the second screens at their respective discharge ends; generating vibration onto the screens to permit material to move under gravity on the screens or pass through the screens; supplying material to be screened onto the surface of the first screen; and conveying material delivered from the discharge end of the screening device by the first conveyor.

According to a further aspect of the present invention there is provided a mobile material processing plant including a screening assembly as illustrated above. In particular, a mobile material processing plant includes a mobile crusher machine and the screening assembly as illustrated above that is rigidly or releasably secured on the mobile crusher machine.

As to the advantages and preferred embodiments regarding the method and the mobile material processing plant, reference is made to the corresponding aspects and embodiments described above with respect to the screening assembly.

While preferred embodiments of the present invention have been illustrated and described, it will be understood that changes and modifications may be made therein without departing from the invention in its broader aspects.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
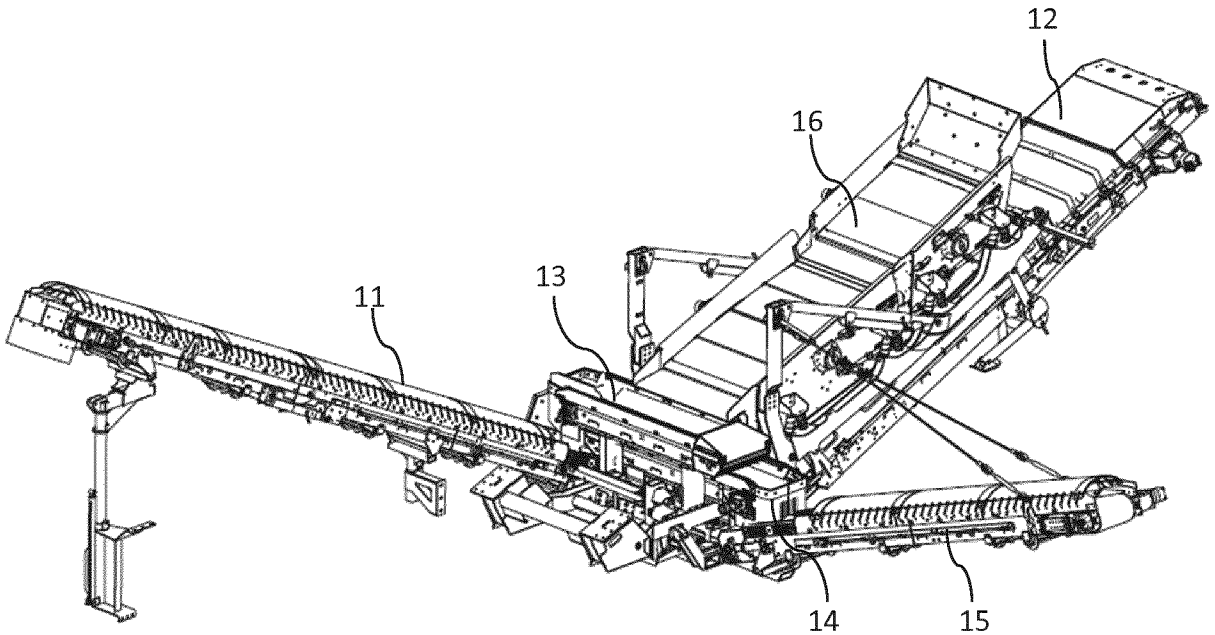
FIG. 1 is a perspective view of an existing screening assembly.
Figure 2:
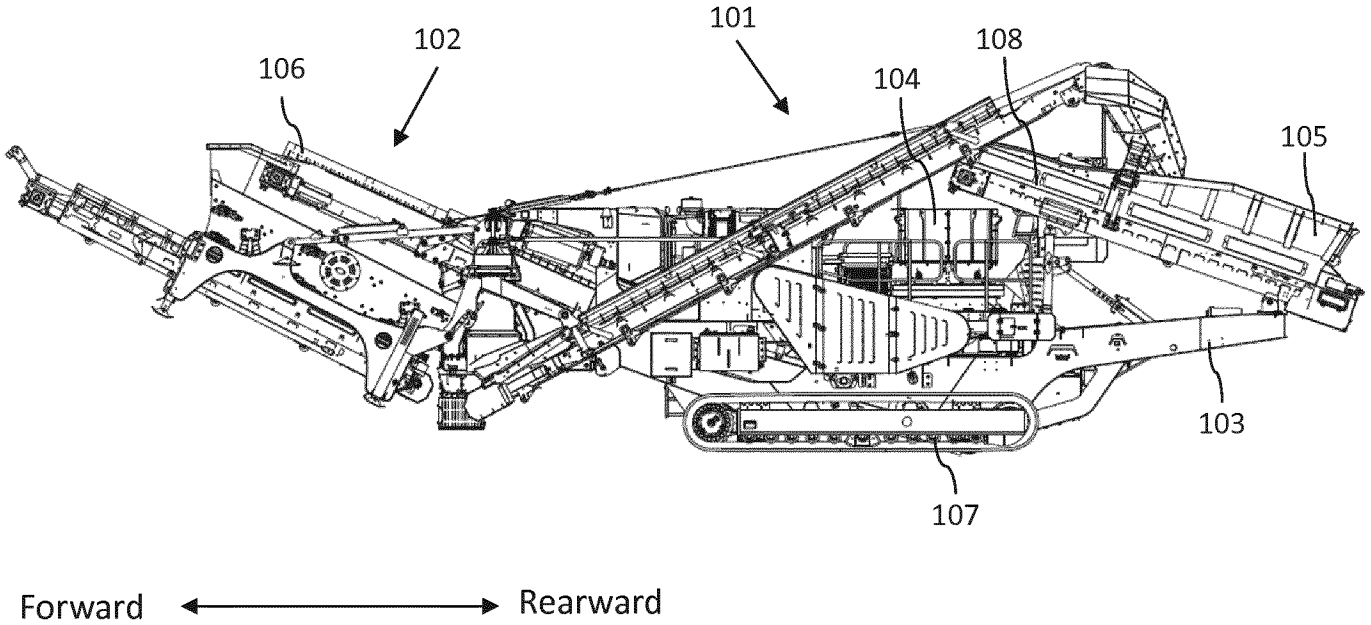
FIG. 2 is an elevation view of a mobile material processing plant according to a specific implementation of the present invention.

Referring to FIG. 2, a mobile material processing plant includes a mobile crusher 101 and a screening assembly 102 which may be rigidly or detachably mounted on the mobile crusher. The plant includes a machine mainframe 103 which carries at a rearward end a crushing unit 104 e.g. a cone crusher or jaw crusher or impact crusher or the like, the mainframe further supports a belt conveyor 108 to supply the material to the crushing unit. A chute or hopper 105 is arranged above the conveyor to hold the material. Alternatively a vibrating feeder may be used to move material forward to a jaw/impact crushers. A supply conveyor 106 is arranged on the mainframe for transporting the material processed by the crusher to the screening assembly 102 to the forward end of the plant. The machine mainframe is mounted via undercarriage on a crawler track 107 on either side to make the material processing plant mobile.

Figure 3A:
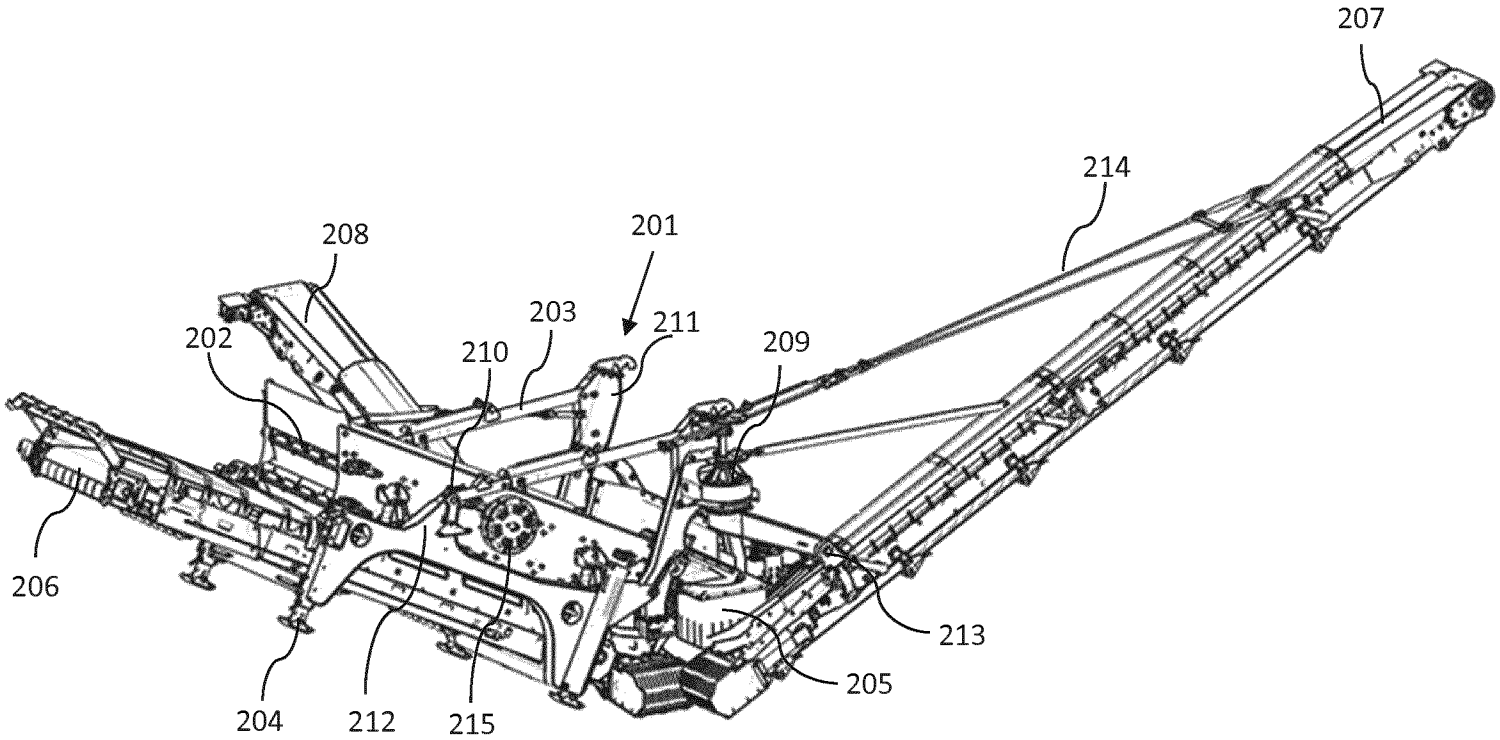
FIG. 3*a* is a perspective view of a screening assembly according to a specific implementation of the present invention.

FIG. 3*a* shows a perspective view of a screening assembly 102 according to a specific implementation of the present invention. It includes an assembly frame 201 which may be rigidly or detachably coupled to the machine mainframe 103, the assembly frame 201 carries a screening device 202 that may accommodate vertically-stacked multiple screens.

The assembly frame 201 may have on either side one or more jacking legs 204 that may be extendable, for supporting the whole screening assembly on the ground when the screening assembly is detached from the mobile crusher.

A transfer conveyor 205 is mounted on the assembly frame and arranged transverse to the longitudinal orientation of the assembly. It is located adjacent to the screen discharge end for receiving over-sized material passing over the discharge end of a screen, and may include an endless belt driven by a motor enabling the belt to run in both forward or backward directions. The transfer conveyor 205 forwards material onto a recirculation conveyor 207.

Figure 3B:
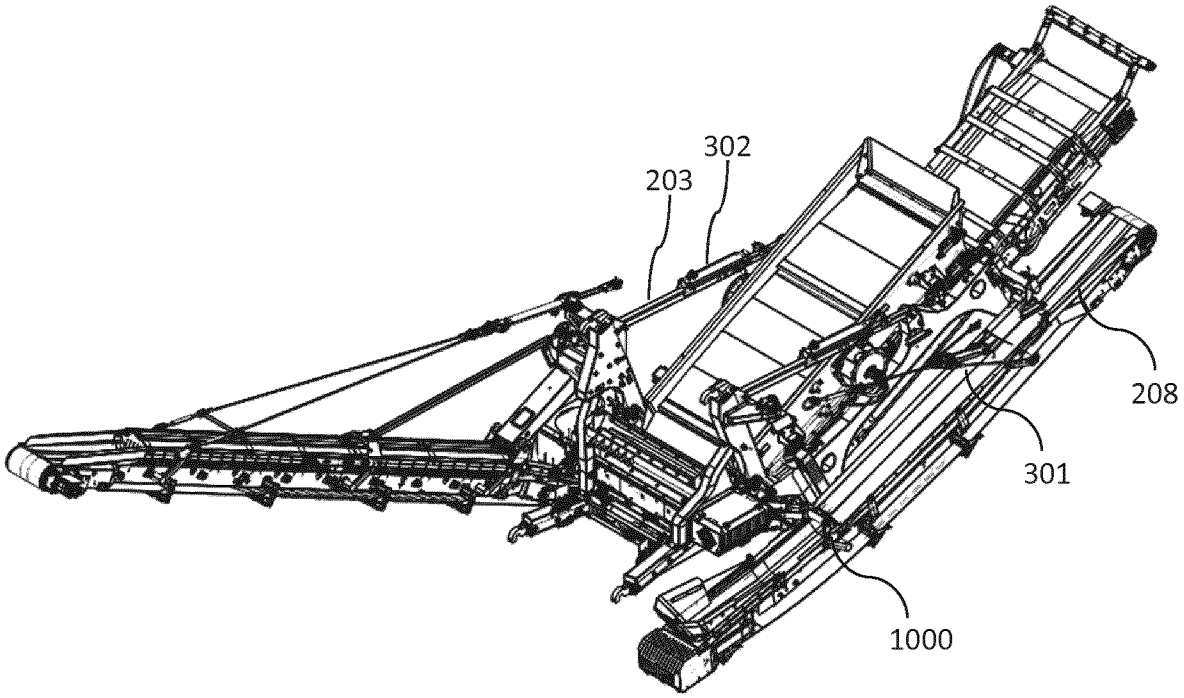
FIG. 3*b* is a perspective view of a screening assembly according to a specific implementation of the present invention, seen from the side of the stockpile conveyor.
Figure 4:
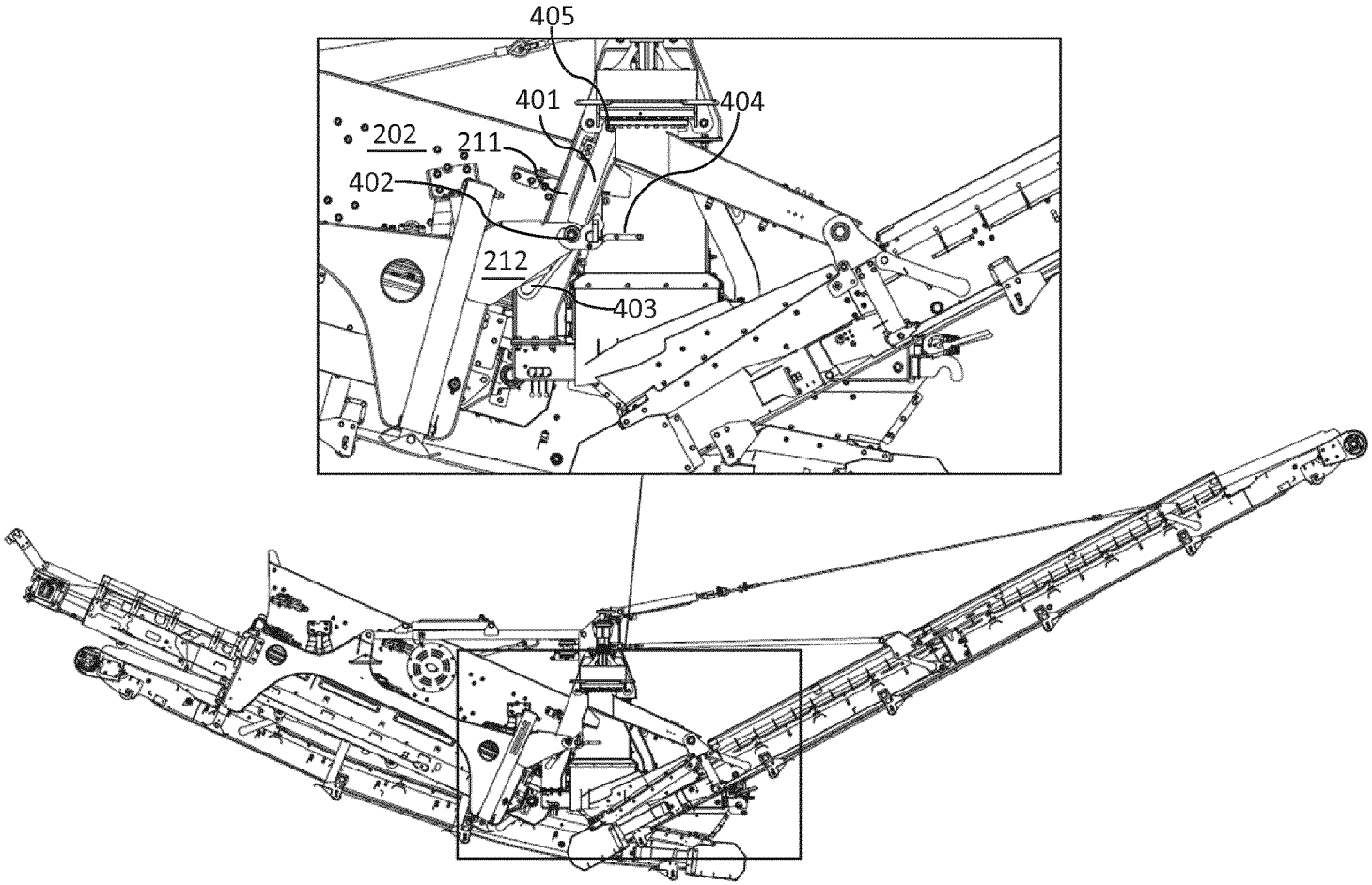
FIG. 4 is an elevation view of a screening assembly together with a magnified view showing the coupling between the carrier frame and the rearward end of the screen support frame.

In a preferred embodiment as shown in FIGS. 3*a*, 3*b* & 4, the assembly frame 201 may be comprised of two sub-frames: a carrier frame 211 and a screen support frame 212, the carrier frame 211 carries a transfer conveyor 205 and includes couplings suitable for couplable with a mobile crusher. On either side of the assembly, the screen support frame 212 is movably coupled to the carrier frame 211 at rearward end via a drive means 401; at a position towards its forward end i.e. at pivot support 210, the screen support frame 212 is pivotably attached to the carrier frame 211 via a connecting means 203 which may be an arm or a cylinder or a telescopic arm powered by a cylinder 302; the connecting means 203 is preferably a screen angle adjust support that may be set up for adjusting the tilting angle of the screening device 202, the screen angle adjust support may be a piston cylinder arrangement. The screening device 202 is mounted on the screen support frame 212 by a number of vibration reduction units such as springs or equivalent The screening device 202 may be defined by a pair of substantially parallel side walls which are interconnected by transversely extending bridging members. Two or more decks, i.e. upper deck 501 and lower deck 502, may be mounted on the bridging members. Each screen deck has small openings or slots or apertures for under-sized particles to pass through. The openings in the upper deck are larger than those of the lower deck. A vibration generation means 215 is incorporated for imparting vibration onto the screens to permit material to move under gravity on the screens or pass through the screens.

Preferably, the screening device may be of the double-screen type, as shown in FIG. 3*b*, wherein the screening device has two upper decks cascaded along the longitudinal direction of the screening device such that the material may pass over an upper deck and sequentially onto the next stage upper deck, and a similar structure implemented for the lower decks. Alternatively, the screening device may include two inline independent screenboxes.

A recirculation conveyor 207 is arranged on one side of the assembly frame, it is rotatable about an attachment bracket 209 to permit its receiving end to be positioned adjacent to the transfer conveyor so that the material from the transfer conveyor is delivered to the recirculation conveyor 207.

Optionally, a stockpile conveyor 208 may be arranged on the other side of the assembly frame in order to receive material delivered from the transfer conveyor. This means, the belt of the transfer conveyor may be controlled to run in different directions, in one direction the material is delivered to recirculation conveyor 207, whereas when running in the other opposite direction the material is delivered to stockpile conveyor 208, this is shown in FIG. 3*a*, where the stockpile conveyor is set up in a working position. As illustrated in FIG. 3*b* the stockpile conveyor may be set up in a transport position.

A fines conveyor 206 is further secured to the assembly frame 201, in particular secured to the screen support frame 212, and arranged beneath the screening device 202 for receiving under-sized material passing through the screens and transporting the material to the forward end of the assembly.

In FIG. 4 a magnified view of the coupling between the carrier frame and the rearward end of the screen support frame is shown. The screening assembly 102 is equipped with a cylinder 401, one end 405 of the cylinder is pivotably coupled to the carrier frame 211, the other end of the cylinder is pivotably connected to a pivot pin 402 of the screen support frame, the carrier frame 211 includes a slot 403 that is substantially upright and tilting slightly rearward, the cylinder 401 may lift the pin 402 upward or downward to displace the discharge end of the screening device, this movement is enabled due to the screen support frame 212 being pivotably coupled to the carrier frame 211 at the forward end at pivot support 210. A latching bracket 404 may be implemented to lock the pivot pin 402 within the slot firmly in position, especially when the screening device is brought to a higher slot position as shown in FIG. 4.

Figure 5:
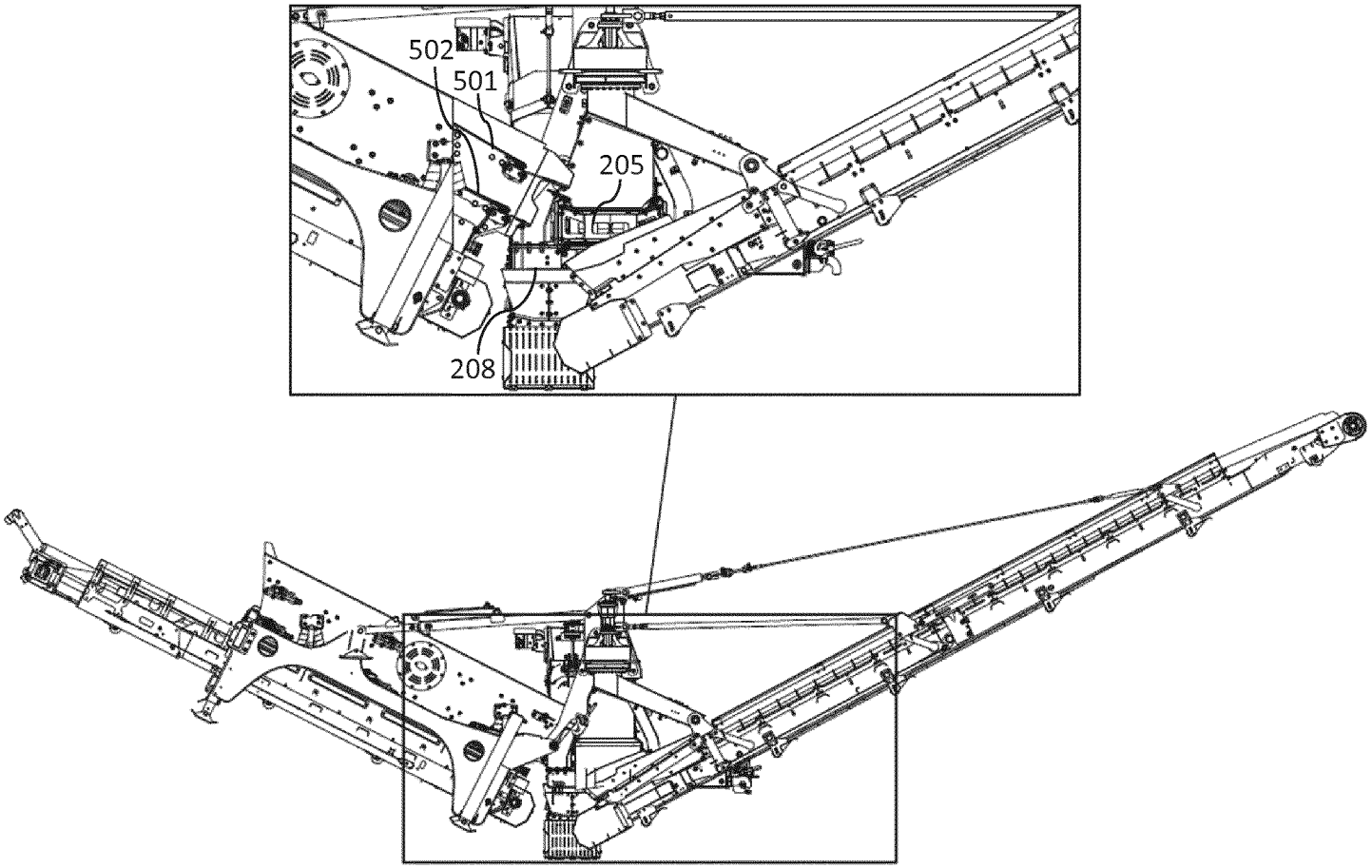
FIG. 5 is an elevation view of a screening assembly together with a magnified view showing the coupling between the carrier frame and the rearward end of the screen support frame, wherein the screen support frame is placed at its lower slot position.

FIG. 5 shows, the screen support frame 212 is placed at its lower slot position where over-sized material passing over the discharge end of the upper deck 501 is delivered to the transfer conveyor 205, parallelly over-sized material passing over the discharge end of the lower deck 502 is delivered to the stockpile conveyor 208 arranged substantially below the transfer conveyor. For facilitating the material flow, a chute can be arranged for guiding the material from the decks onto the conveyors, or for the purpose of preventing dust emission to the air environment. In this working position, the belt on the transfer conveyor runs opposite to that of the belt on stockpile conveyor.

Figure 6:
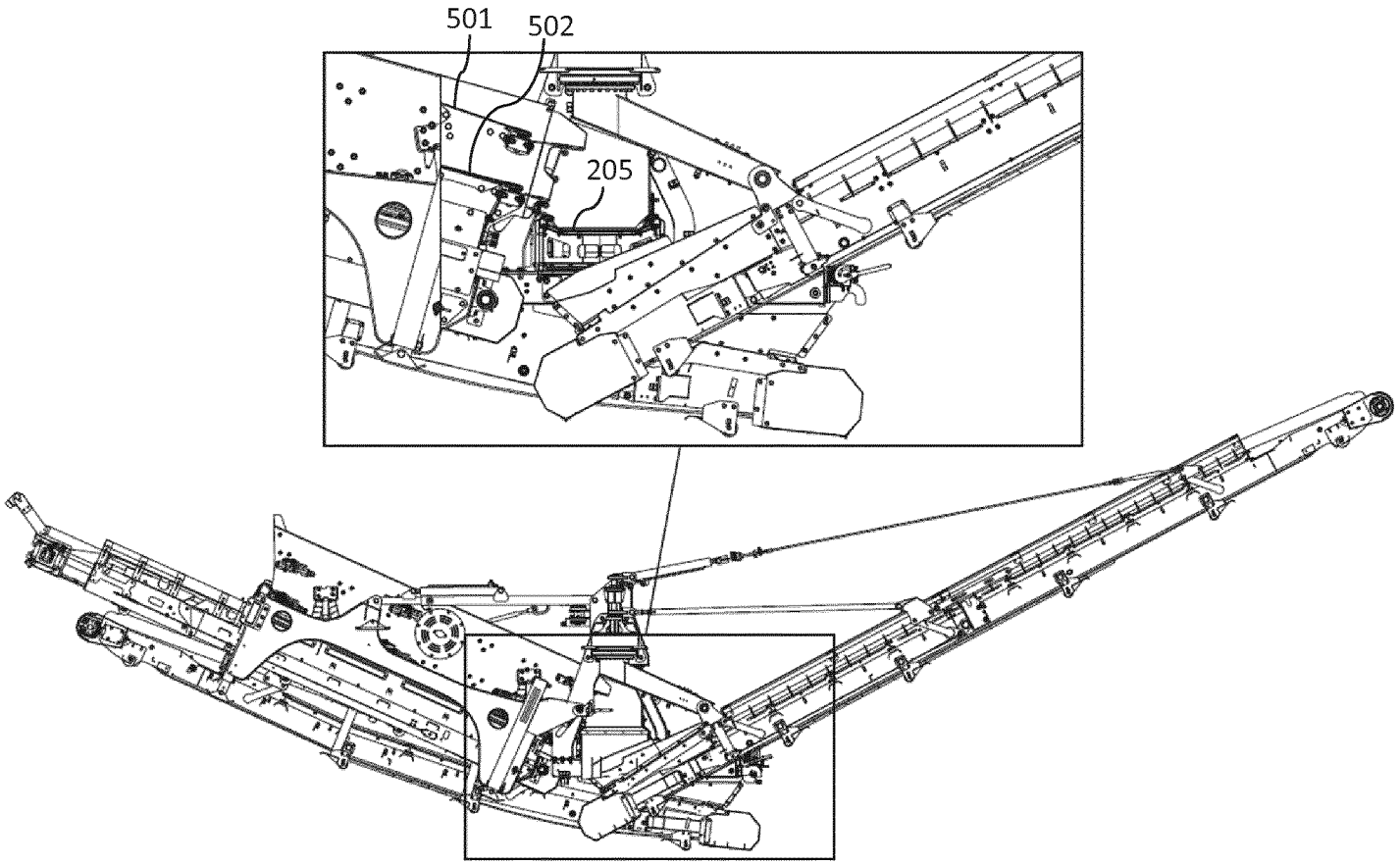
FIG. 6 is an elevation view of a screening assembly together with a magnified view showing the coupling between the carrier frame and the rearward end of the screen support frame, wherein the screen support frame is placed at its higher slot position.

When the screening assembly is in its second working position as shown in FIG. 4, i.e. the screen support frame 212 being raised into its higher slot position, material flow is indicated in FIG. 6, over-sized material passes over the discharge ends of both upper & lower decks are delivered to the transfer conveyor 205, in this case, a stockpile conveyor is dispensed with. Also, it is appreciated that the ground clearance left below the screen support frame 212 is increased, in comparison to the case as illustrated in FIG. 5.

Figure 7:
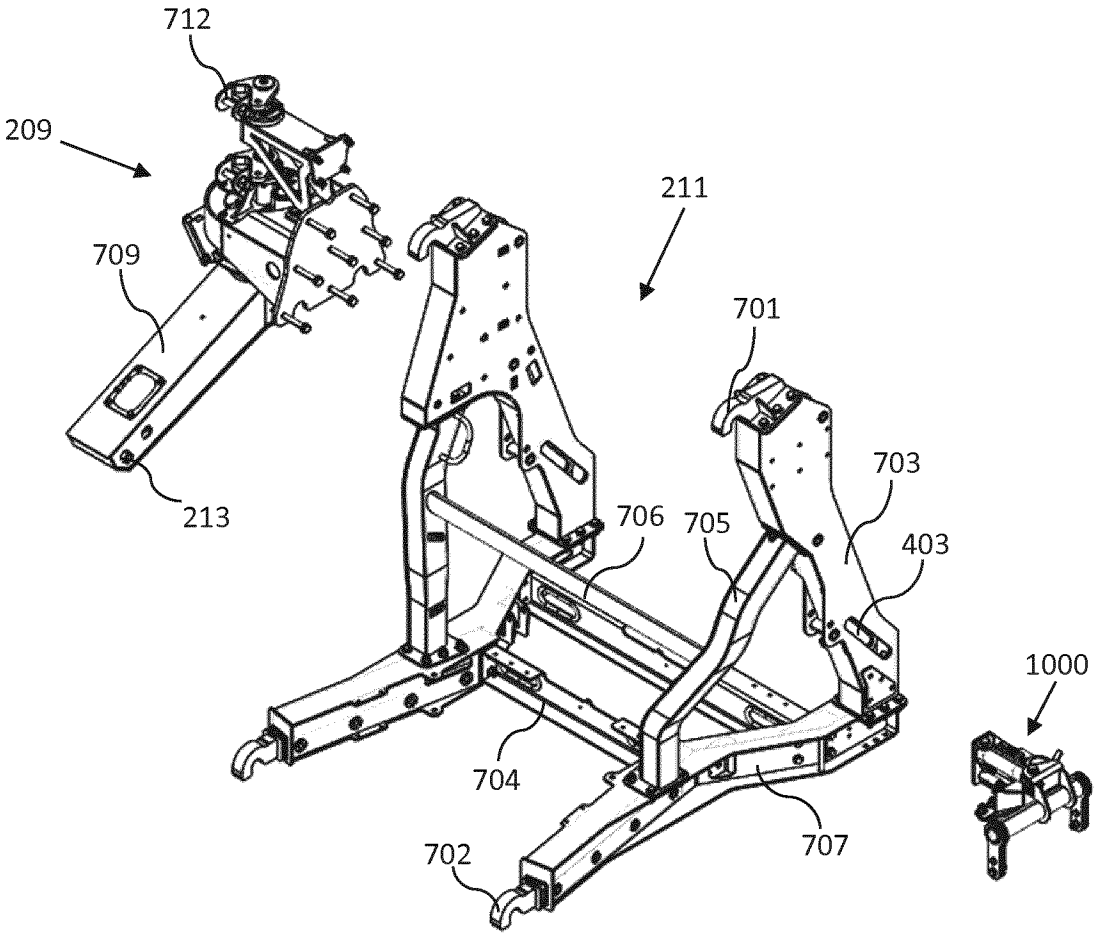
FIG. 7 is a perspective view of the carrier frame of the assembly frame together with an attachment bracket and a pivot bracket.

Referring to FIG. 7 a perspective view of the carrier frame 211 is shown. The carrier frame 211 includes a pair of generally upstanding posts 703 having slots 403 embedded therein, and a pair of standing posts 705 leaning oppositely against and joining the posts 703 respectively at each side, as well as elongate beams 707 for connecting and binding the lower ends of the posts. The carrier frame 211 may further include at least one cross strut 704 and/or at least one cross bar 706 extending between the posts and the beams to reinforce the frame. These elements may be fixed together by bolts and the like, in practice some of these elements may be welded together. The carrier frame 211 may include a pair of upper coupling 701 and lower coupling 702 on either side to allow the screening assembly to be coupled to machine mainframe 103. This coupling 701, 702 may be in the form of hook which may complementarily engage a pin connection on the machine mainframe 103, alternatively it would be possible for this coupling to be a single boss/bush mounted by a single pin/bolt through the hole. A pivot bracket 1000 is also shown which can be mounted at the carrier frame for rotatably supporting the stockpile conveyor 208.

An attachment bracket 209 is mounted on the carrier frame 211, and configured to rotatably support the recirculation conveyor 207, the bracket 209 includes a slewing arm 709 extending downwardly and be rotatable about a vertical axis, the slewing arm 709 at its distal end is pivotably coupled to a proximal end of the recirculation conveyor 207 at a pivot joint 213. The recirculation conveyor at its distal end and/or at mid-section is attached to the connectors 712 via connecting bars, strings, ropes, or rods and the like 214, so as to allow the recirculation conveyor 207 to be rotatably suspended on the carrier frame 211. Referring to FIG. 3, the recirculation conveyor is rotatable in the horizontal plane in a range of 180 degrees.

Figure 8:
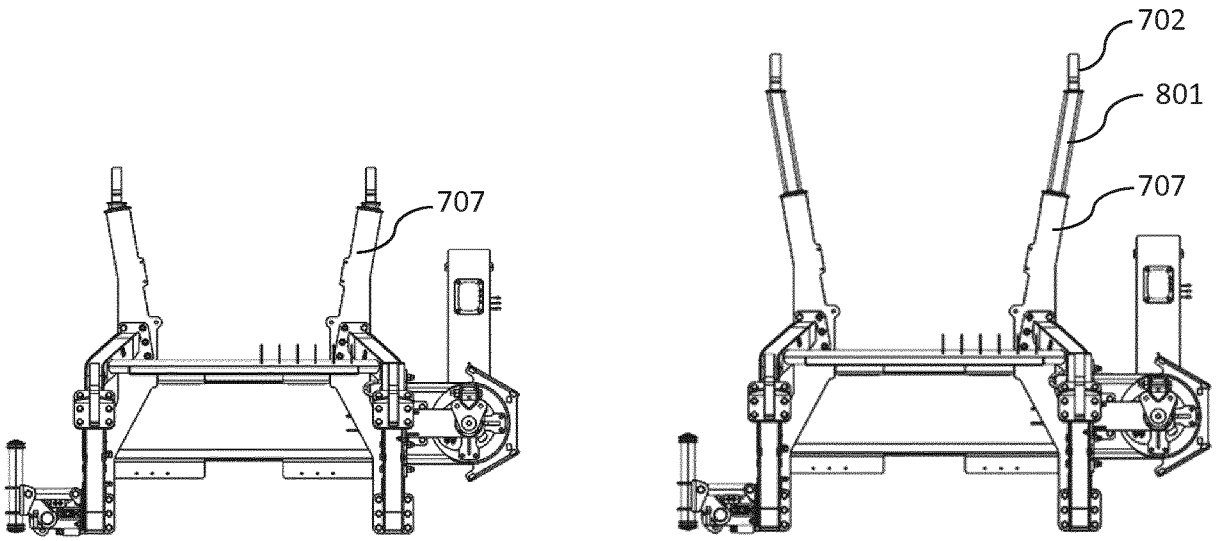
FIG. 8 is a top perspective view of the carrier frame.

FIG. 8 shows a perspective view of the carrier frame seen from the top. The elongate beam 707 at the rearward end extends laterally outward to form an angled support arm, in particular, the elongate beam is of sleeve structure where a beam 801 is slidably extendable within the sleeve, the beam 801 at its rearward end has coupling 702 on it, this configuration is advantageous for the screening assembly to match and adapt to different mobile crushers. In case the distance between connection joints on the base crusher machine is narrow, the beam 801 can be retracted to a certain degree; otherwise the beam 801 can be extended to allow a large distance between couplings 702. The figure on right-hand side shows the beam in extended state.

Figure 9:
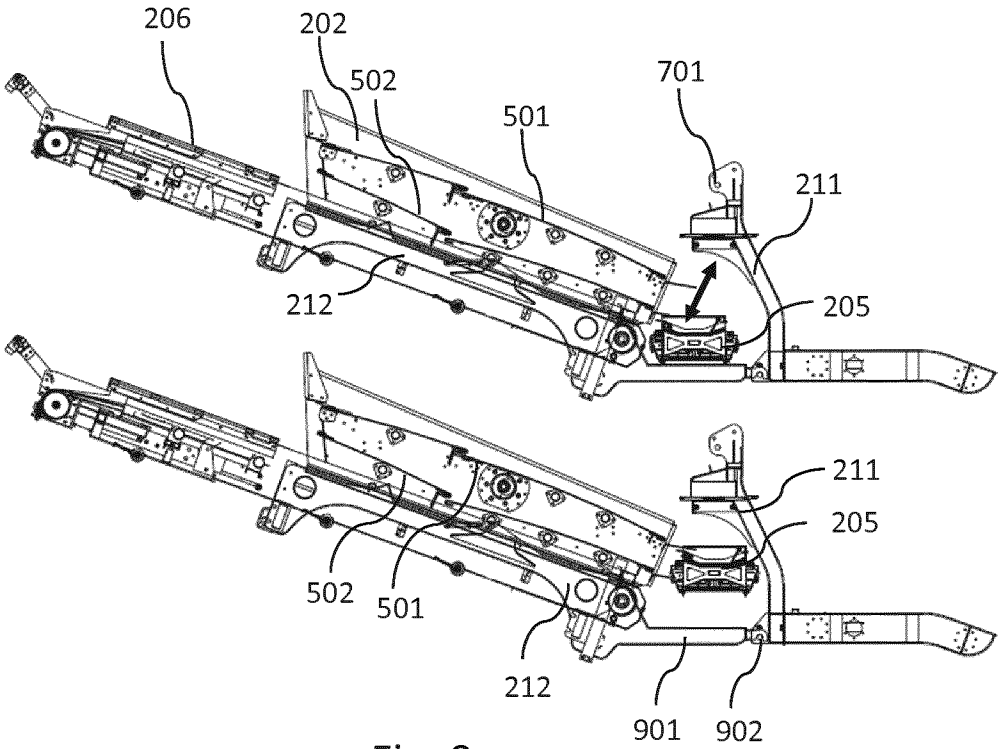
FIG. 9 is a pair of section views of a screening assembly according to another specific implementation of the present invention.

In contrast to the above solution where the screen support frame is shifted at forward end, an alternative solution is to have the transfer conveyor to be shifted by a drive means to allow the transfer conveyor to be positioned in two work positions. In the first work position as shown in the bottom of FIG. 9, the transfer conveyor receives material from the upper deck, whereas in the second work position as shown on the top of FIG. 9, the transfer conveyor receives material from both upper and lower decks. In this implementation, the screen support frame 212 is pivotably engaged with the carrier frame 211 at pivotable coupling 902, a connecting arm (not shown) in the from of a piston/cylinder device or a telescopic arm driven by a piston/cylinder and the like, connects the screen support frame 212 at its forward end (in particular, at a position departing from the rearward end of the screen support frame) to the coupling 701 of carrier frame 211. As illustrated in FIG. 9, the screen device 202 and the fines conveyor 206 are supported on the screen support frame 212, the transfer conveyor 205 may be movably supported by the carrier frame 211, a drive means (not shown) may lift or lower the transfer conveyor 205 in substantially vertical direction, however parallelly the transfer conveyor 205 may need also to move slightly forward or backward. The arrow in the top figure indicates the moving direction of the transfer conveyor 205. Optionally a chute or guiding plate may be introduced to guide the material from the deck onto the transfer conveyor. In the bottom figure, the transfer conveyor 205 has been raised to a upper position, thus leaving clearance between the transfer conveyor and the elongate beam 901 of the assembly frame. A receiving end of the stockpile conveyor 208 may be in the form of a cantilever structure, which is suitable for being inserted or embedded within the clearance/space, so as to allow the stockpile conveyor 208 to receive material from the lower deck 502.

Figure 10:
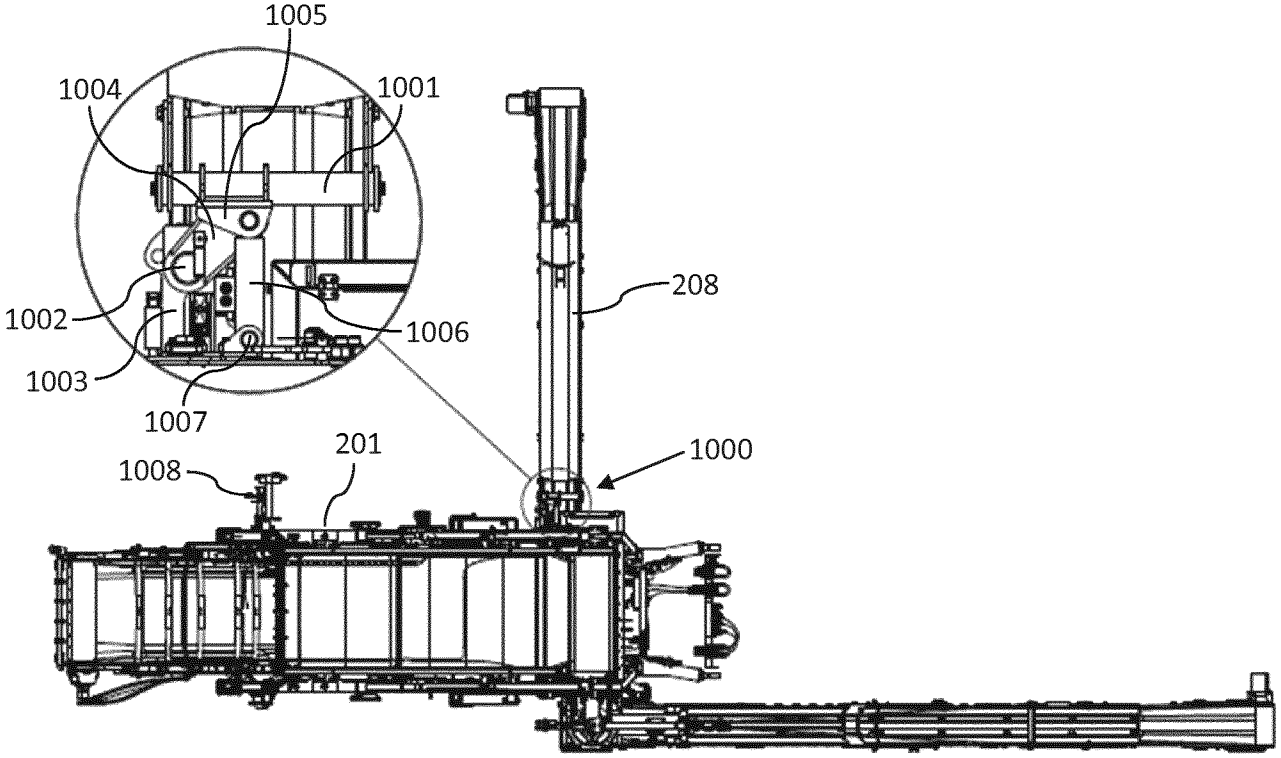
FIG. 10 is a top view of a screening assembly with a stockpile conveyor, wherein the stockpile conveyor is placed in work position.
Figure 11:
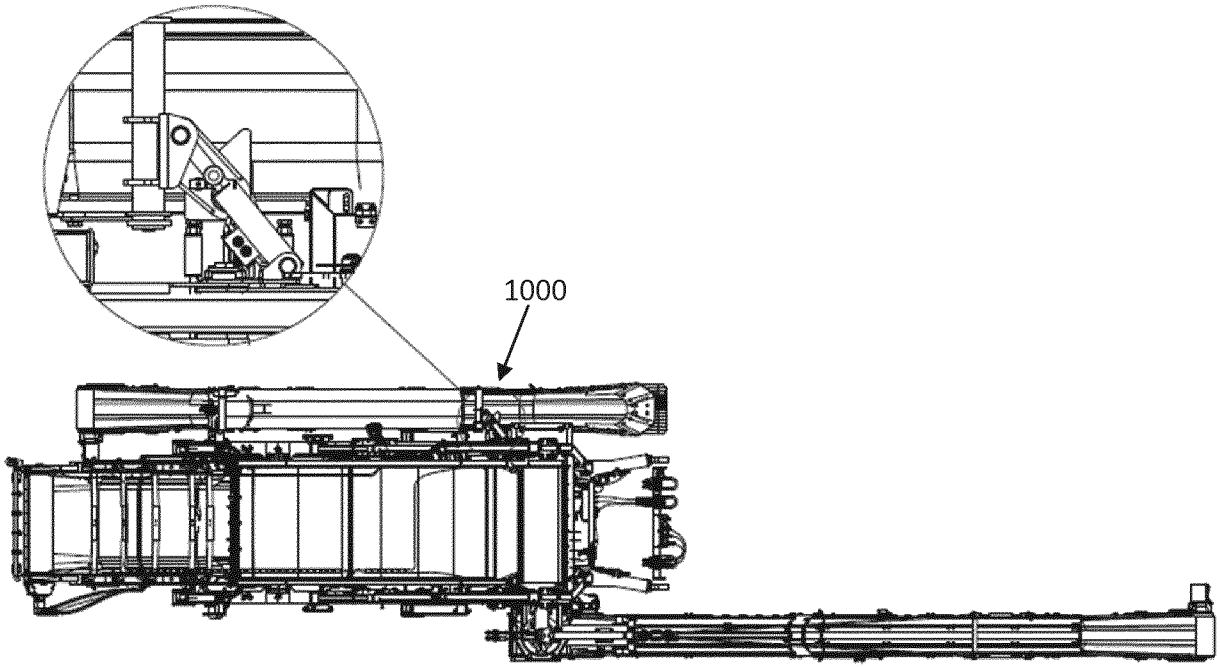
FIG. 11 is a top view of a screening assembly with a stockpile conveyor, wherein the stockpile conveyor is placed in non-work position.

FIG. 10 depicts a stockpile conveyor pivot bracket 1000. The stockpile conveyor 208 is rotatable in the range of 0° to 90° from its work position as shown in FIG. 10 to a non-work position as shown in FIG. 11. The pivot bracket 1000 has a carrier 1001 to pivotably hold the conveyor 208 on both sides. A carrier support 1003 extends laterally from the assembly frame 201 and includes a vertical pivot 1002, the carrier support 1003 carries an arm 1004 that is slewable about vertical pivot 1002, the distal end of the arm 1004 connects to a seat 1005 for holding the carrier 1001. The carrier 1001, the arm 1004 & the seat 1005 may be all part of one welded structure. A cylinder 1006 has one end pivotably coupled to the carrier frame 211, the distal end of the cylinder is rotatably connected to the seat 1005. The powered cylinder 1006 may drive the stockpile conveyor 208 to rotate about the vertical pivot 1002. In its work position the stockpile conveyor 208 may be further supported from above at a position forwards its distal end by use of wire ropes 301 that can be extended/retracted to change the angle of the conveyor for operation/transport. Whereas in its non-work position the conveyor 208 is placed parallel to the longitudinal direction of the assembly and rests on the assembly frame via a foldable support 1008.

In operation, the screening assembly is adjusted by the aid of cylinder 401 to set the assembly in an intended work position, i.e. the screen support frame 212 is placed in a lower slot position as shown in FIG. 5 or raised into a higher slot position as shown in FIG. 6. A vibration generating means is also started to impart vibration onto the screens. The material to be processed is brought by a loading truck or a conveyor and fed to the chute 105, the material is subsequently conveyed by the belt conveyor 108 to the crusher 104, after having been processed by the crusher the material is then loaded on the rearward end of the supply conveyor 106, which in turn transports the material towards the forward end to the screening device 202.

Depending on the set work position of the screening assembly, material flow path may vary. If the screen support frame 212 is raised into a higher slot position as shown in FIG. 6, material moves under gravity along the surface of vibrating decks and passes over the discharge end of both decks, and falls onto the transfer conveyor 205, and subsequently be transported onto the belt of recirculation conveyor 207, the recirculation conveyor 207 brings the oversized material back to chute 105 for recycling processing.

If the screen support frame 212 is placed in a lower slot position as shown in FIG. 5, it is necessary to set up the stockpile conveyor 208, i.e. to bring it to a transverse position as shown in FIG. 10, the receiving end of stockpile conveyor 208 is located adjacent the lower deck, so that material passing over the lower deck 502 falls on the stockpile conveyor 208 and is transported laterally to the distal end, for stock piling or onward processing. Material from the upper deck 501 falls on the transfer conveyor 205 and be returned by recirculation conveyor 207 back to the chute 105 for recycling.

Material passing through the lower deck drops on the fines conveyor 206 and is conveyed to the forward end of the assembly.

The screening assembly and the mobile material processing plant can be used in the mining or recycling or construction industry etc. for bulk material processing such as crushing, sizing, stockpiling and the like.

The invention claimed is:

1. A screening assembly for screening material comprising:

an assembly frame;

a screening device coupled to the assembly frame, the screening device including a first screen and a second screen, the second screen being substantially vertically-stacked below the first screen, each of the first and second screens having a discharge end;

a first conveyor coupled to the assembly frame and configured to receive at a receiving end material from at least one of the screens at respective discharge ends of the first and second screens, wherein the first conveyor is arranged transversely relative to a longitudinal direction of the screening device, the first conveyor being a transfer conveyor; and a drive means mounted at the assembly frame, wherein the drive means is operable to shift at least one of the discharge ends of the screening device and the receiving end of the first conveyor relative to the assembly frame, to allow the first conveyor to selectively receive material from the first screen at the discharge end of the first conveyor or from respective discharge ends of the first and the second screens.

2. The assembly of claim 1, wherein the assembly frame includes a carrier frame and a screen support frame movably coupled to the carrier frame, wherein the carrier frame is configured to support the first conveyor and the screen support frame is configured to support the screening device.

3. The assembly of claim 2, further comprising a second drive means, communicating with the carrier frame and the screen support frame, and being operable to change a tilting angle of the screening device.

4. The assembly of claim 3, wherein the second drive means is a piston/cylinder device or a telescopic arm driven by a piston/cylinder device.

5. The assembly of claim 1, wherein the shifting operation includes lifting or lowering at least one of the discharge ends of the screening device and the receiving end of the first conveyor relative to the assembly frame.

6. The assembly of claim 1, wherein the drive means is a hydraulically actuated piston/cylinder device having a first end that is pivotably attached to one of the screen support frame and the first conveyor, a second end of the piston/cylinder device being pivotably connected to the carrier frame, wherein the drive means is arranged to act on one of the screening device and the first conveyor via a telescopic arm.

7. The assembly of claim 6, wherein the carrier frame includes a slot and a latching bracket, wherein one of the screen support frame and the first conveyor includes a coupling configured to engage the first end of the drive means or the telescopic arm, wherein the latching bracket is operable to latch the coupling within the slot.

8. The assembly of claim 7, wherein the coupling is a pin support.

9. The assembly of claim 1, further comprising a second conveyor coupled to the assembly frame and arranged below the screening device for receiving under-sized material from the screening device.

10. The assembly of claim 9, further comprising a third conveyor coupled to the assembly frame, the third conveyor being arranged transversely relative to a longitudinal direction of the screening device and operable to receive over-sized material from the discharge end of the second screen, wherein the third conveyor is a stockpile conveyor.

11. The assembly of claim 10, wherein the third conveyor is rotatable in horizontal plane about a pivot mechanism of the assembly frame.

12. The assembly of claim 10, wherein the screening device, the first, second and third conveyors the assembly frame, and/or an attachment bracket that is mounted on the carrier frame and configured to rotatably support the recirculation conveyor, are of a modular structure.

13. The assembly of claim 10, wherein the screening device, the first, second and third conveyors, the assembly frame, and/or an attachment bracket that is mounted on the carrier frame and configured to rotatably support the recirculation conveyor, are each constructed of various modules that are bolted together.

14. The assembly of claim 1, wherein further comprising a recirculation conveyor mounted at the assembly frame for receiving material delivered from the first conveyor.

15. The assembly of claim 1, wherein the first conveyor and/or the drive means and/or the recirculation conveyor are mounted separately from the assembly frame, the first conveyor, the drive means and/or the recirculation conveyor being mounted on a base machine, the base machine being a mobile crusher.

16. The assembly of claim 15, wherein the assembly frame is configured to detachably couple to the base machine, wherein upon coupling, a supply conveyor of the base machine is configured to be located above the first screen and to feed material onto the first screen.

17. The assembly of claim 15, wherein the assembly frame includes support arms configured to be couplable with the base machine, wherein the arms each have an angled telescopic portion.

18. A method for processing material in a screening assembly as claimed in claim 1, the method comprising:

adjusting the screening assembly by the aid of the drive means to set the assembly in an intended work position, wherein at least one of the discharge ends of the screening device and the receiving end of the first conveyor is displaceable relative to the assembly frame by the drive means to allow the first conveyor to selectively receive material from the first screen at the discharge end of the first conveyor or from respective discharge ends of the first and the second screens;

generating vibration onto the screens to permit material to move under gravity on the screens or pass through the screens;

supplying material to be screened onto a surface of the first screen; and conveying material delivered from the discharge end of the screening device by the first conveyor.

19. A mobile material processing plant including the assembly according to claim 1.

* * * * *